United States Patent [19]

Farrar et al.

[11] Patent Number: 4,726,638

[45] Date of Patent: Feb. 23, 1988

[54] TRANSIENT SUPPRESSION ASSEMBLY

[75] Inventors: John C. Farrar, Harrisburg; Reuben E. Ney, Mount Joy; James L. Schroeder, III, Palmyra, all of Pa.

[73] Assignee: AMP Incorporated, Harrisburg, Pa.

[21] Appl. No.: 758,711

[22] Filed: Jul. 26, 1985

[51] Int. Cl.[4] ..... H01R 13/66

[52] U.S. Cl. ..... 439/620 R; 333/185; 439/608

[58] Field of Search ..... 339/147 R, 147 P; 333/181, 182, 183, 184, 185; 361/56, 91

[56] References Cited

U.S. PATENT DOCUMENTS

| | | | |
|---|---|---|---|
| 3,452,252 | 6/1979 | Mapham . | |
| 4,070,084 | 1/1978 | Hutchison . | |
| 4,106,839 | 8/1978 | Cooper | 339/143 R |
| 4,144,509 | 3/1979 | Boutros | 339/147 R |
| 4,198,613 | 4/1980 | Whitley . | |
| 4,330,166 | 5/1982 | Cooper et al. | 339/143 R |
| 4,365,282 | 12/1982 | Brainard . | |
| 4,407,552 | 10/1983 | Watanabe et al. | 339/147 R |
| 4,580,866 | 4/1986 | Hagner | 339/147 R |
| 4,582,385 | 4/1986 | Couper et al. | 339/147 R |
| 4,600,256 | 7/1986 | Anttila | 339/17 M |

FOREIGN PATENT DOCUMENTS

| | | |
|---|---|---|
| 0024193 | 12/1980 | European Pat. Off. . |
| 3311410 | 10/1983 | Fed. Rep. of Germany . |
| 2119182 | 11/1983 | United Kingdom . |

OTHER PUBLICATIONS

"Suppress EMP at the Interface with Versatile Diode Device," ITT Cannon/Global Connection, Spring 1984, p. 7.

*Primary Examiner*—Gil Weidenfeld
*Assistant Examiner*—Gary F. Paumen
*Attorney, Agent, or Firm*—Katherine A. Nelson; Anton P. Ness

[57] ABSTRACT

A transient suppression assembly for protecting individual circuits on printed circuit boards and for retrofitting existing electrical connectors is disclosed. The assembly is comprised of a dielectric substrate means having terminal engaging means disposed thereon, a grounding means and transient suppression means such as diodes electrically connecting said terminal engaging means and said ground means for suppressing voltages outside a specified level as they are conducted through terminals of the connector and said terminal engaging means.

9 Claims, 14 Drawing Figures

Fig. 6
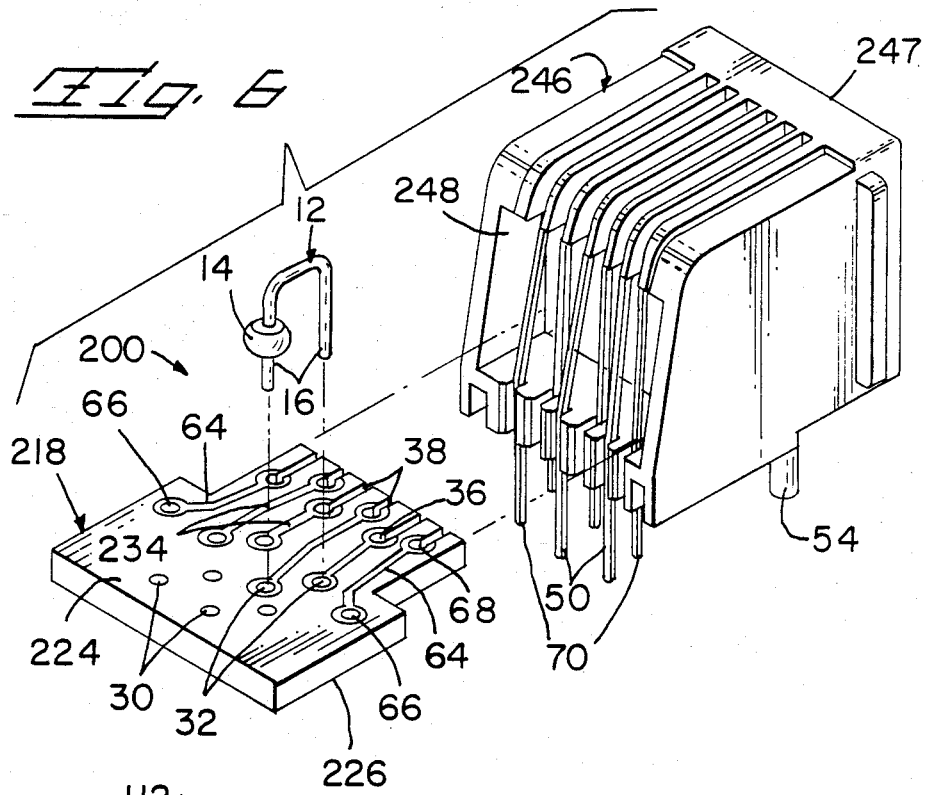
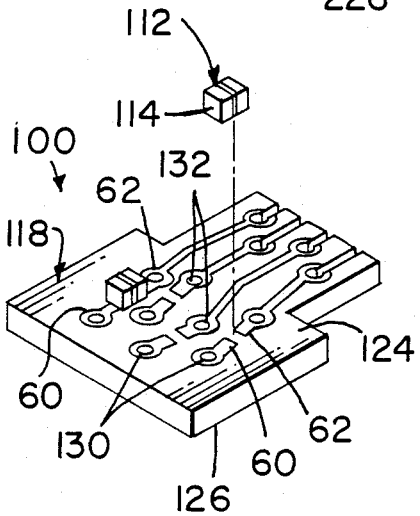
Fig. 5
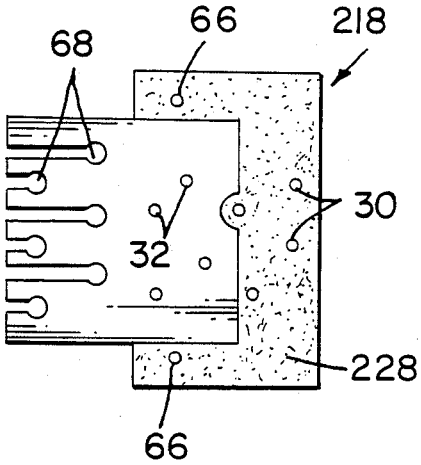
Fig. 7

TRANSIENT SUPPRESSION ASSEMBLY

FIELD OF THE INVENTION

This invention relates to electrical connectors and more particularly to electrical connectors providing protection against electromagnetic interference, radio frequency interference and especially against voltage surges.

BACKGROUND OF THE INVENTION

Electrical circuitry often must be protected from disruptions caused by electromagnetic interference (EMI) and radio frequency interference (RFI) entering the system. EMI energy can be generated outside of as well as inside the system and can occur anywhere in the electromagnetic spectrum. External EMI energy is an undesired conducted or radiated electrical disturbance that can interfere with the operation of electronic equipment, while internal EMI energy is the unwanted noise or unwanted interference generated by electrical or electronic circuitry within a system.

RFI is now used interchangeably with EMI but generally is limited to interference in the radio communication band. Connectors are particularly susceptible to EMI energy because of the numerous contact areas and openings for cable and external electrical contacts. The art, however, has developed sophisticated electrical connectors having substantial shielding effectiveness against EMI/RFI energy.

Another type of electromagnetic radiation, however, was observed with the development of nuclear explosives. The nuclear explosion, and in some circumstances large scale chemical explosions, produces a sharp pulse (large impulse-type) of radio frequency (long wave length) electromagnetic radiation. Unlike EMI/RFI which are localized effects, the intense electric and magnetic fields created by electromagnetic pulse (EMP) energy can damage unprotected electrical and electronic equipment over a wide area. EMP energy consists of a broad spectrum of energies delivered in a fraction of a second. Peak field strengths can reach tens of kilovolts per meter within nanoseconds. These intense pulses induce high voltages and currents which generate a variety of complex electrical events within a system. Damage can range from a momentary interruption of operation to total overload and burn-out of electronic circuits. Multiple electromagnetic pulses generate more damage since electronics can experience local damage from a first pulse, which degrades performance and degrades the device or circuits, so that the following pulse results in the complete destruction.

Within every new generation of electronics more components are packed into smaller spaces which makes the circuits more susceptible to EMP damage. This high device packaging-density inhibits the ability of the circuit to conduct away the heat which results from the typical intense, high voltage and current flows generated by an EMP. As a result, there is an increased demand for electrical connectors having protection against EMP and EMI energy threats.

In addition there is also a need to protect electronic equipment from power surges owing to electrostatic discharges (ESD). The high voltags generated by ESD can damage voltage sensitive integrated circuits.

One means to protect against EMI, RFI, ESD and EMP energy is by the use of shielding. One such shielding means is disclosed in U.S. Pat. No. 4,330,166. This patent discloses the use of a conductive spring washer seated in the plug portion of the connector so as to make electrical contact with the receptacle portion of the connector when the plug and receptacle are mated. One washer thus provides shielding for a multitude of electrical circuits. For adequate protection, it is essential therefore that there be no break in the continuity of the shielding.

Other means for protecting againt voltate surges include the use of additional specialized circuitry within equipment, such as voltage variable resistors.

It is an object of the present invention to provide a transient suppression device for use with a variety of connectors. It is a further object to include means that can be used to protect each individual circuit from any transient voltage. Furthermore, it is an object to provide a minimum inductance ground path thus assuring minimum response time.

SUMMARY OF THE INVENTION

This invention is directed to a transient suppression means for protection of individual circuits on circuit boards or to retrofit or modify existing connectors. The transient suppression assembly is comprised of a dielectric substrate means having connector engaging means disposed thereon, a grounding means and transient suppression means electrically connecting said connector engaging means and said grounding means for suppressing voltages outside a specified level as they are conducted through said connector engaging means. Another means for providing protection against power surges is disclosed in copending U.S. patent application Ser. No. 758,712 entitled Transient Suppression Device and filed concurrently herewith.

Some of the objects and advantages of the invention having been stated, others will appear as the description proceeds when taken in connection with the accompanying drawings.

BRIEF DESCRIPTION OF THE DRAWINGS

FIG. 5 shows an alternative embodiment of the dielectric substrate and transient suppression means of the transient suppression assembly;

FIG. 6 is an exploded perspective view of an alternative embodiment of the transient suppression assembly used with a modular jack connector;

FIG. 7 is a bottom view of the dielectric substrate of FIG. 6;

DETAILED DESCRIPTION OF THE PREFERRED EMBODIMENT

Figure 1:
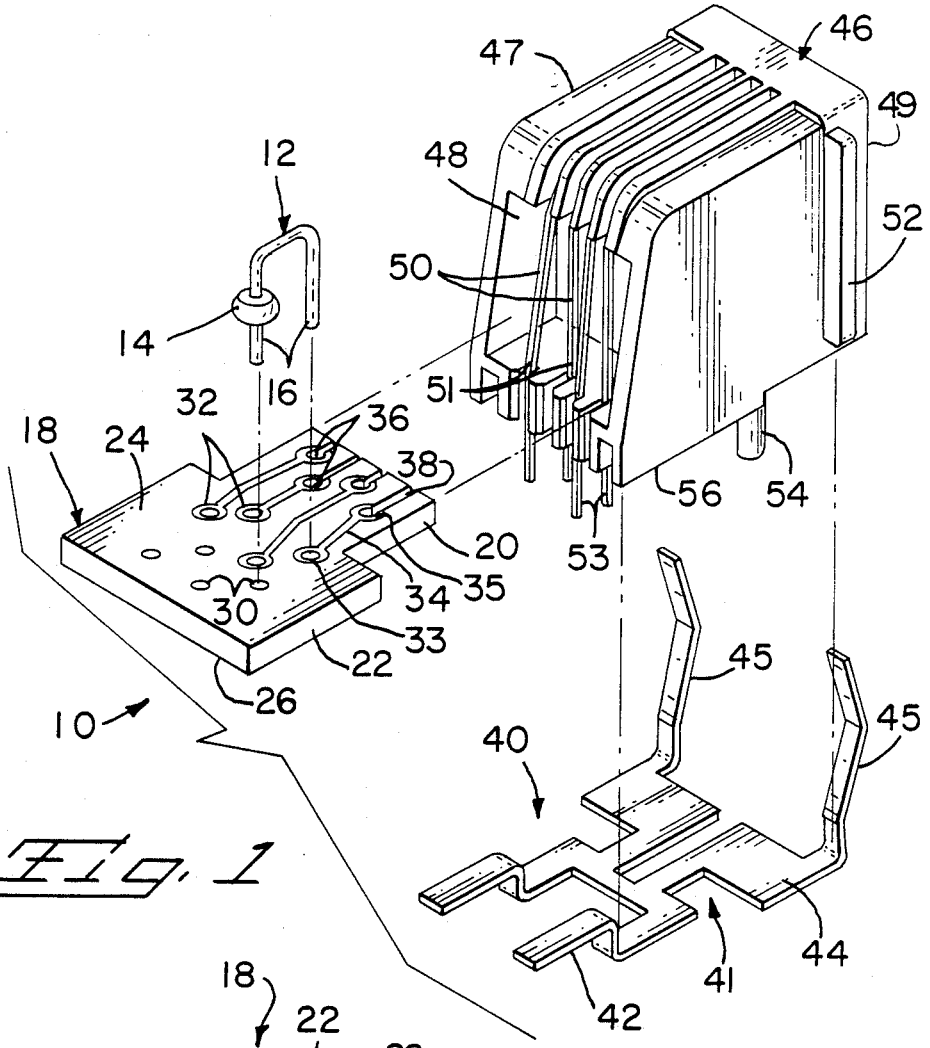
FIG. 1 is an exploded perspective view of the transient suppression assembly used with a modular jack connector.
Figure 2:
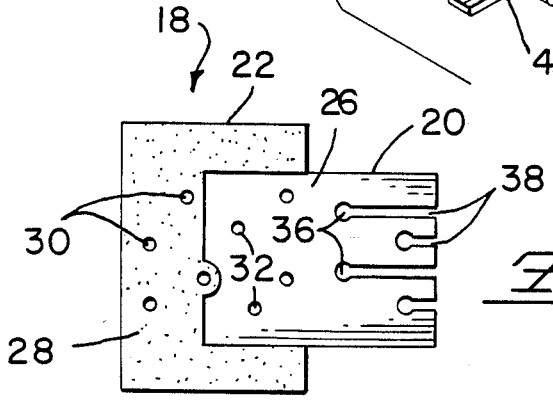
FIG. 2 is a bottom view of the dielectric substrate of FIG. 1.

Referring to FIGS. 1 and 2, transient suppression subassembly 10 is comprised of a transient suppression means 12, a dielectric substrate means 18, and a ground means 40. Subassembly 10 is intended to be used with an existing housing assembly or connector 46 for retrofitting that connector 46 to provide for protection against power surges. Connector 46 is generally comprised of a dielectric housing member 47 having a first face 49 and a second or lower face 56, with terminals 50 secured therein and having first contact sections (not shown) proximate first face 49 to engage corresponding contact means of a first electrical article (not shown) and second contact sections 53 extending downwardly below lower housing face 56 to engage corresponding contact means of a second electrical article (not shown). Housing member 47 also has a cavity 48 extending thereinto from the rear side through which extend exposed portions 51 of terminals 50 in a staggered pattern. In the preferred embodiment, housing member 47 also has a ground plane engaging extension 52. Housing member 47 further has mounting legs 54 extending from lower surface 56 of connector 46, legs 54 being used to mount the connector to a circuit board or other surface (not shown). A modular jack connector is used for purposes of illustration only. It is to be understood that other connectors may also be used with the invention.

Transient suppression menas 12 is comprised of a bi-directional diode 14 having leads 16 extending therefrom. Dielectric substrate 18 has a first portion 20 which is profiled for insertion into a cavity 48 in connector housing member 47, and for engagement with terminals 50 therein, and a second portion 22 which remains external to housing member 47.

Figure 3:
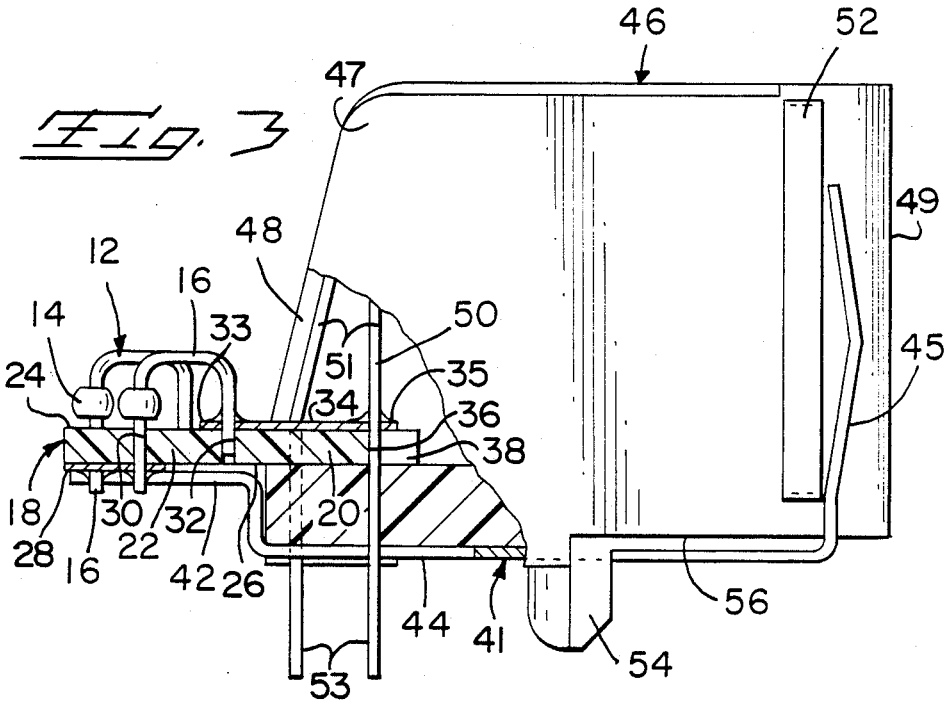
FIG. 3 is a side elevation view partly broken away of the modular jack of FIG. 1 mounted to the assembly.

Dielectric substrate 18 has a first major side or upper surface 24 having a plurality of conductive paths 34 disposed thereon, and a second or lower surface 26 having a ground conductor surface area 28 thereon. Substrate 18 further has a plurality of first and second lead-receiving apertures 30, 32 for mounting suppression means 12, lead-receiving apertures 30, 32 extending from upper surface 24 to lower surface 26. First apertures 30 extend from a dielectric area of upper surface 24 through substrate 18 and into ground conductor surface area 28 on lower surface 26. Second apertures 32 extend from a second path portion 33 at one end of each of the conductive paths 34, through substrate 18 and into a dielectric area on lower surface 26. Transient suppression means 12 is mounted to substrate 18 by inserting one of the leads 16 of each diode 14 into the first aperture 30 and the other lead 16 into the second aperture 32 as is best seen in FIG. 3. The lead 16 in the first aperture 30 is thus electrically connected with ground conductor surface area 28 and the other lead is electrically connected with conductive path 34, when secured thereto by conventional means such as by soldering, as shown in FIG. 3.

As shown in FIGS. 1 and 2 substrate 18 further has terminal engaging means thereon, the terminal engaging means being comprised of a plurality of terminal receiving passageways 36 extending from first path 35 at the other ends of each of conductive paths 34 through substrate 18 and into a dielectric area of lower surface 26, and a terminal engaging slot 38 which extends outwardly from each passageway 36 to a leading edge of first substrate portion 20. When first substrate portion 20 is inserted into housing member 47, slots 38 engage respective terminals 50 in housing member 47. When first substrate portion 20 is fully seated in housing member 47, terminals 50 are in their respective terminal receiving passageways 36 upon soldering, as shown in FIG. 3, and thereby electrically connected to respective first portions 35 of conductive paths 34 and respective transient suppression means 12.

Figure 4:
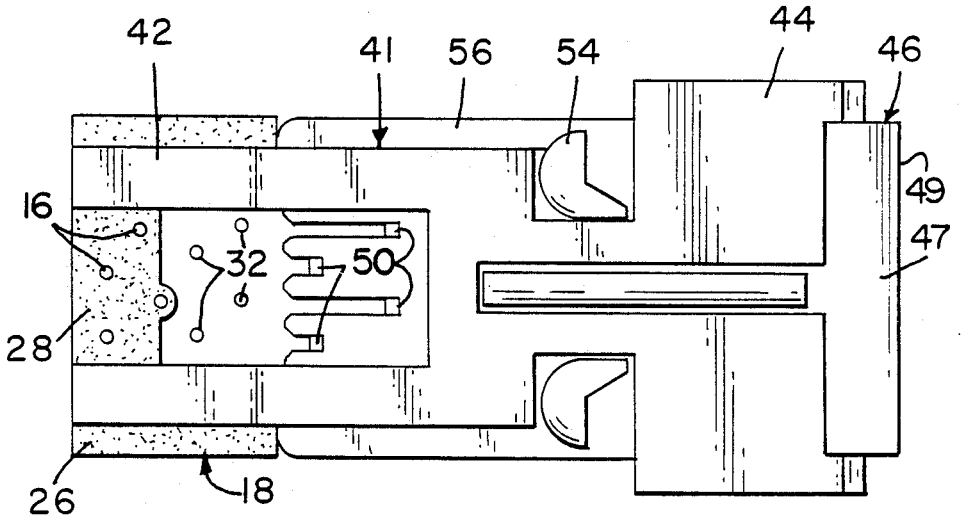
FIG. 4 is a bottom view of the assembly and modular jack of FIG. 3.
Figure 8:
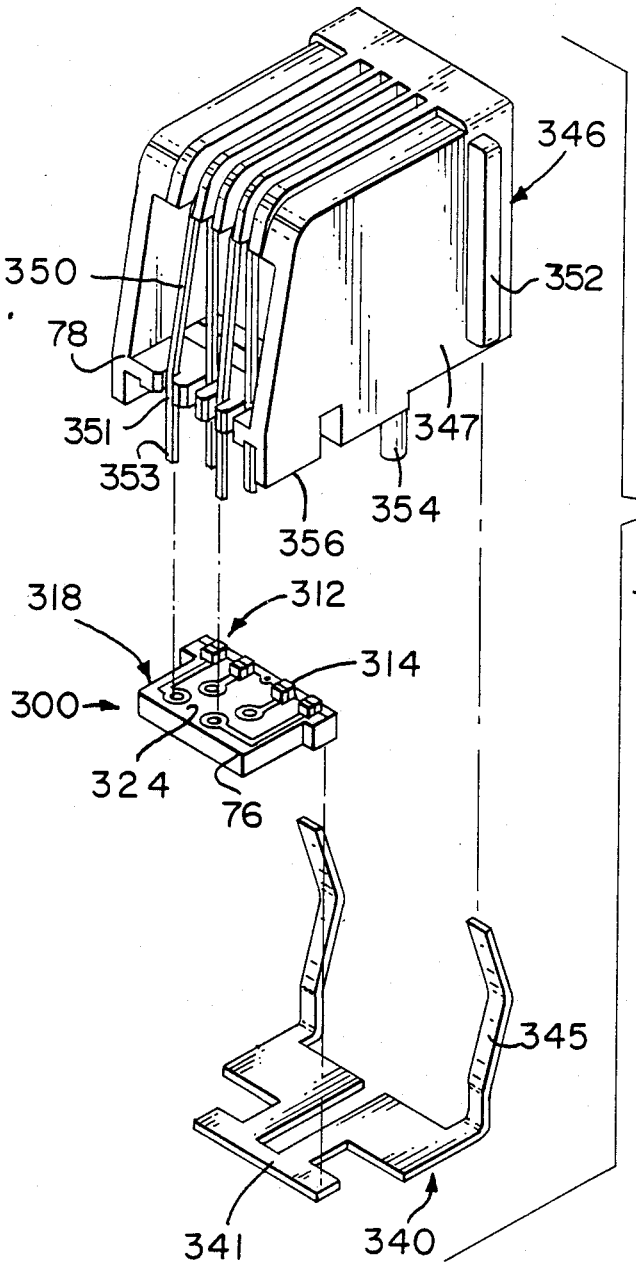
FIG. 8 is an exploded perspective view of a further alternative embodiment of the transient suppression assembly.
Figure 9:
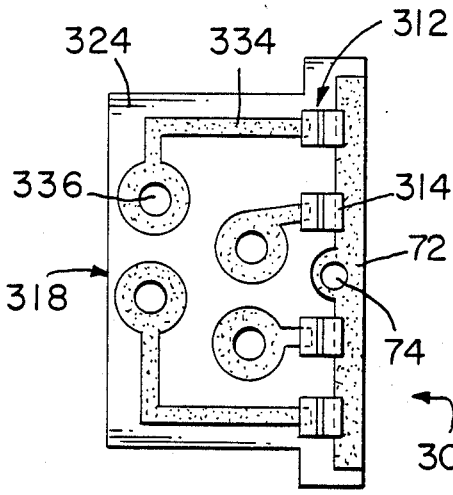
FIG. 9 is a top view of the dielectric substrate of FIG. 8.
Figure 10:
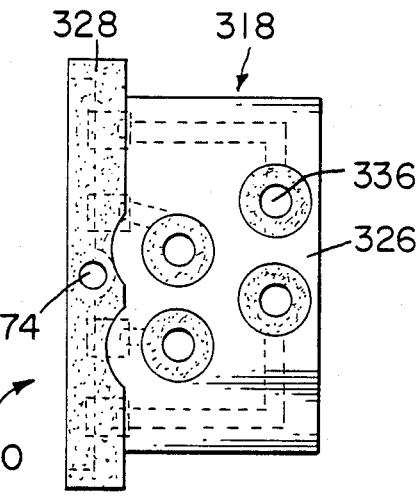
FIG. 10 is a bottom view of the dielectric substrate of FIG. 8.

Ground means 40 is comprised of a ground plate 41 having first portion 42 for engaging substrate 18 and a second portion 44 for engaging connector 46. Second portion 44 is profiled to accept connector 46. Grounding plate 41 is shaped so that substrate engaging portion 42 will electrically interconnect with ground conductor surface area 28 on undersurface 26 of substrate 18 but will not engage the leads 16 that extend through apertures 32 and into the dielectric portion of undersurface 26. This is best illustrated in FIG. 4. Connector engaging portion 44 of ground plate 41 has arms 45 extending upwardly to engage extension 52 on connector housing member 47, as is shown in FIG. 3.

FIG. 5 illustrates an alternative embodiment 100 of the transient suppression assembly. In this embodiment, the transient suppression means 112 is a surface mounted bi-directional diode 114. To facilitate mounting of diode 114 conductive pads 60, 62 on upper substrate surface 124 surround first and second apertures 130 and 132, apertures 130 and 132 extending respectively to ground conductor surface area 28 (shown in FIG. 4) and to the dielectric portion of substrate undersurface 26 in the same manner as previously described with embodiment 10. Diode 114 is soldered to interconnect respective pads 60 and 62. Since diode 114 is unleaded, apertures 130 and 132 are made to be electrically conductive by means known in the art such as by plating, solder or the like to provide electrical interconnection between surfaces 124 and 126 of substrate 118 and thus provide an electrical connection between pads 60 and the ground conductor surface area on lower surface 126. This embodiment 100 is inserted into the connector in the same manner as described above.

FIGS. 6 and 7 illustrate a further embodiment 200 of the transient suppression assembly in which substrate 218 has ground conductive paths 64 as well as signal conductive paths 234 disposed on substrate surface 224. Ground conductive paths 64 are electrically interconnected via apertures 66 to ground conductor surface area 228 on substrate undersurface 226 of substrate 218 by means known in the art. When substrate 218 is inserted into connector 246, said ground conductor paths 64 are electrically interconnected at 68 to connector ground terminals 70. The remaining terminal receiving passageways 36 electrically engage signal ones of terminals 50 as previously described.

FIGS. 8 to 12 illustrate a further embodiment 300 of the transient suppression assembly comprised of a dielectric substrate 318, transient suppression means 312 and grounding means 340 securable to a connector 346. In this embodiment bi-directional diodes 314 are surface mounted to substrate surface 324 and interconnect conductive paths 334 to ground conductive path 72 on upper surface 324. Aperture 74 is provided in ground path 72 and electrically connected to ground conductor surface area 328 on substrate undersurface 326, as shown best in FIGS. 9 and 10.

Figure 11:
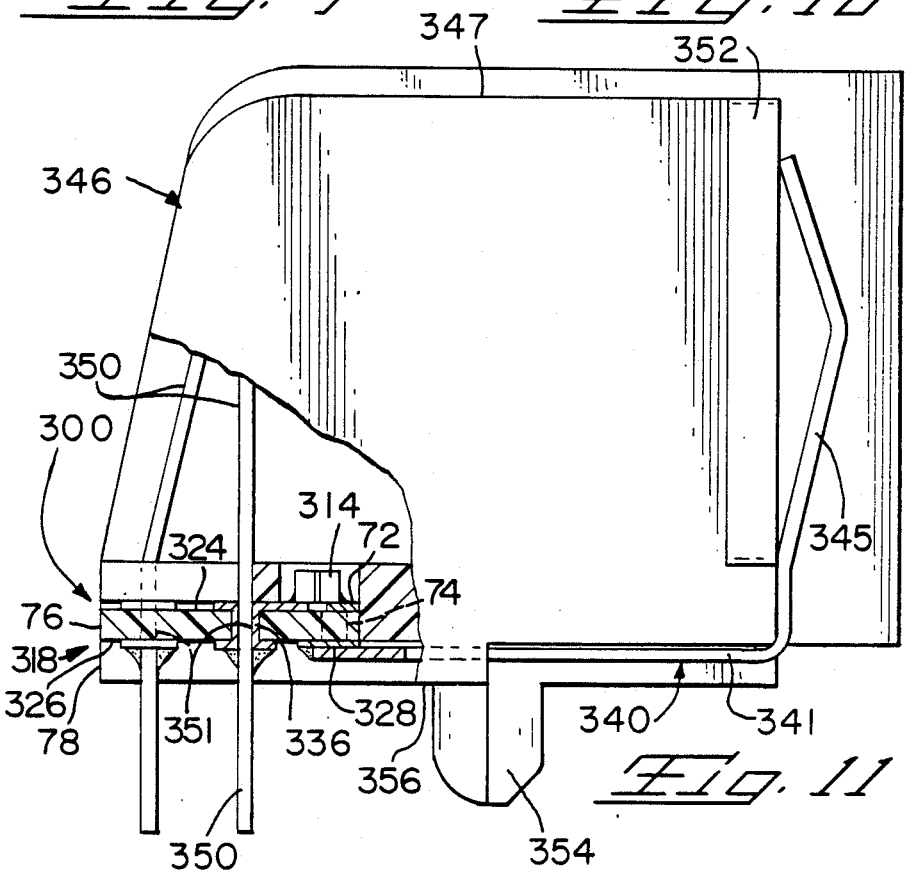
FIG. 11 is a side elevation view partly broken away with the transient suppression assembly of FIGS. 8 to 10 mounted within the connector.
Figure 12:
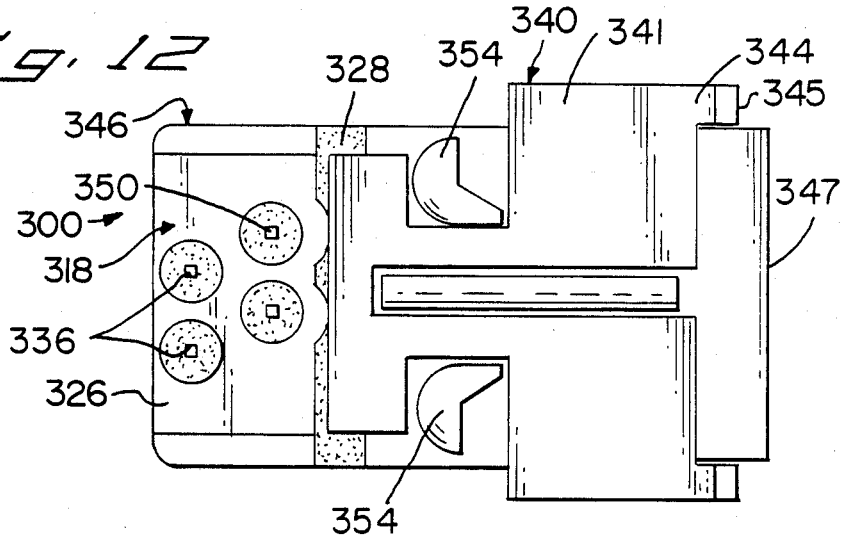
FIG. 12 is a bottom view of the assembly and connector of FIG. 11.

As is shown in FIG. 11, a portion of the bottom 356 of housing member 347 is profiled to receive assembly 300. Terminals 350 have second contact portions 353 and adjacent exposed portions 351 which extend below the bottom surface of housing member 347 and are received through terminal receiving passageways 366. The assembly 300 is inserted into the profiled opening axially along second contact sections 353 and against the bottom surface of housing member 347 so that edge 76 of the assembly 300 is essentially flush with back edge 78 of housing member 347. Once substrate 318 has been seated in housing member 347, ground plate 341 is attached. As is shown in FIG. 12 ground plate 341 is profiled to engage ground conductor surface area 328. Arms 345 engage ground plate engaging extensions 352 on housing member 347. This embodiment is particularly useful where space is at a premium and there is no room for the substrate to extend beyond the housing.

Figure 13:
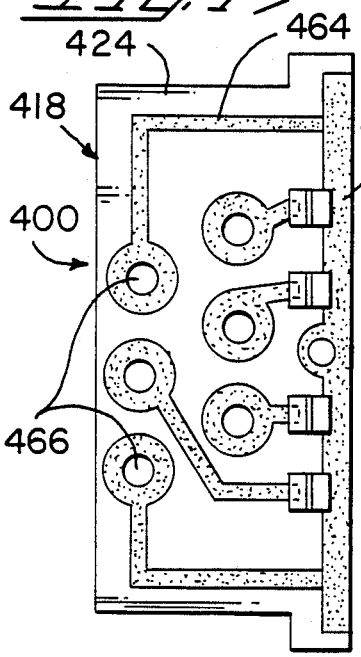
FIG. 13 is a top view of another alternative embodiment of the transient suppression assembly.
Figure 14:
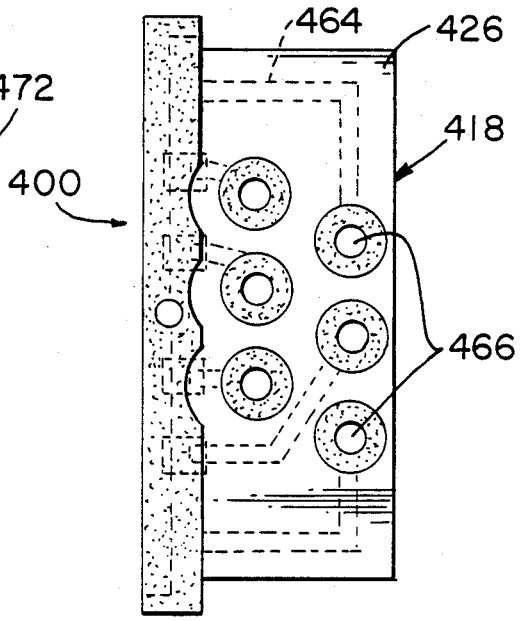
FIG. 14 is a bottom view of the assembly of FIG. 13.

FIGS. 13 and 14 illustrate top and bottom surfaces 424, 426 respectively of a further alternative assembly embodiment 400. In this embodiment assembly 400 is designed to be inserted into a connector in the same manner as assembly 300 described in FIGS. 8 to 12. This embodiment illustrates the use of ground conductive paths 464 disposed on surface 424, said paths 464 being electrically interconnected to corresponding ground terminals extending through apertures 466 upon assembly of transient suppression subassembly 400 to a connector (not shown), thus eliminating the need for a separate ground plate.

The invention disclosed herein provides superior performance in the suppression of transient voltages. The invention also provides a means for protecting circuit boards from transient voltages in that a connector having the means attached thereto may be mounted to a circuit board. The use of transient suppression means in close proximity to the individual terminal members provides a short, minimum induction ground path for any transient signal. Minimum response time is thus assured.

The drawings and specifications have set forth preferred embodiments of the invention, and although specific terms are employed, they are used in a generic and descriptive sense only and not for purposes of limitation.

What is claimed is

1. An electrical connector for electrical connection to first and second electrical articles, comprising:

a housing assembly of a dielectric housing member having a plurality of passageways extending therethrough and a like plurality of electrical terminals secured in said housing member, each said electrical terminal having first and second contact sections, and sections proximate said first contact sections disposed in respective said passageways, said first contact sections being exposed for electrical connection with corresponding contact means of a first electrical article, and said terminals extending outwardly from respective said passageways and from said housing such that said second contact sections are exposed for electrical connection with corresponding contact means of a second electrical article, each said electrical terminal further including proximate said second contact section thereof an exposed terminal portion disposed in a substrate receiving aperture means of said housing member;

a transient suppression subassembly adapted to be received and secured in said substrate receiving aperture means of said housing member after said terminals are secured in said housing member and comprising a dielectric substrate having a plurality of terminal receiving aperture means extending from a first major side to a second major side through a first portion thereof each associated with a respective one of said terminals, said substrate including a like plurality of conductive paths disposed on said first major side thereof each having a first portion adjacent a respective said terminal receiving aperture means and adapted to be electrically connected to a respective one of said terminals extending therethrough upon assembly of said transient suppression subassembly to said housing assembly, said substrate further including a ground conductive means at least including a ground conductive surface area on one of said first or second major sides of said substrate electrically separated from said plurality of conductive paths thereof, and remote from said first portion of said substrate and exposed for engagement with a ground means after assembly to said housing assembly, said ground conductive means extending to surface portions proximate second portions of said conductive paths;

said transient suppression subassembly further including transient suppression devices secured on said first major side of said substrate and electrically connected to respective said second portions of said conductive paths and to respective said surface portions of said ground conductive means; and means securing said transient suppression subassembly to said housing member upon assembly thereto; whereby said transient suppression subassembly is securable to a preexisting said housing assembly such that said terminals extend through respective terminal receiving aperture means, and upon establishment of a ground connection with said ground conductive means, voltages outside a specific level are suppressed as they are conducted through signal ones of said terminals.

2. An electrical connector as set forth in claim 1 wherein said substrate receiving aperture means of said housing member comprises a recess along an outer surface thereof and said second contact sections and said exposed portions of said terinals extend outwardly from said housing member in parallel through said recess and are received through said respective terminal receiving apertures when said subassembly is moved during assembly to said housing assembly along said second contact sections toward said outer surface and into said housing recess with said first major side of said substrate proximate said housing outer surface until said substrate is disposed adjacent said exposed terminal portions.

3. An electrical connector as set forth in claim 2 wherein said ground conductive surface area is disposed on said second major side of said substrate and faces outwardly from said housing assembly after assembly thereto, said surface portions of said ground conductive means are disposed on said first major side proximate respective said second path portions and are electrically connected to said ground conductive surface area by a conductive aperture means extending from said first major side to said second major side, and said transient suppression devices are surface mountable diode members electrically connected to said second path portions and said surface portions of said ground conductive means.

4. An electrical connection as set forth in claim 3 wherein said plurality of electrical terminals include ground terminals and said ground conductive means includes other surface portions electrically connected to said ground terminals after assembly and commoned to at least one of said ground conductive surface area and said surface portions of said ground conductive means.

5. An electrical connector as set forth in claim 1 wherein said substrate receiving aperture means is an opening extending into said housing member from a side surface and along a wall section outwardly through which said second contact sections of said terminals extend, said exposed terminal portions extending across said opening in a staggered arrangement, and said substrate including a plurality of slots extending in parallel from a leading end of said substrate to said first portion in communication with respective said terminal receiving apertures, said slots and said apertures coninciding with said staggered arrangement of said exposed terminal portions, such that said first portion of said substrate is adapted to be received into said substrate receiving opening upon insertion transverse to said exposed terminal portions, and to receive said exposed terminal portions along respective said slots and into respective said terminal receiving apertures.

6. An electrical connector as set forth in claim 5 wherein said substrate includes a second portion extending outwardly from said housing member after assembly thereto, said second portion including said ground conductive surface area on said second major side expoded for grounding.

7. An electrical connector as set forth in claim 6 wherein second aperture means extend through said first portion of said substrate at said second path portions, third aperture means extend through said second portion of said substrate intersecting said ground conductive surface area, and said transient suppression devices are leaded diode members each having a first lead extending through a said second aperture means and a second lead extending through said third aperture means and joined electrically to said second path portions and to said ground conductive surface aera.

8. An electrical connector as set forth in claim 6 wherein said surface portions of said ground conductive means are disposed on said first major side of said substrate in said second substrate portion and conductive aperture means extend through said substrate electrically interconnecting said ground conductive surface area, and said surface portions and said transient suppression devices are surface mountable diode members joined electrically to said second path portions and said surface portions of said ground conductive means.

9. An electrical connector as set forth in claim 8 wherein said diode members are bi-directional diodes.

* * * * *